US010107040B2

(12) United States Patent
Evans et al.

(10) Patent No.: US 10,107,040 B2
(45) Date of Patent: Oct. 23, 2018

(54) EARTH-BORING TOOL HAVING BACK UP CUTTING ELEMENTS WITH FLAT SURFACES FORMED THEREIN AND RELATED METHODS

(71) Applicant: Baker Hughes, a GE company, LLC, Houston, TX (US)

(72) Inventors: Kenneth R. Evans, Spring, TX (US); Oliver Matthews, III, Spring, TX (US); Steven C. Russell, Houston, TX (US)

(73) Assignee: Baker Hughes, a GE company, LLC, Houston, TX (US)

( * ) Notice: Subject to any disclaimer, the term of this patent is extended or adjusted under 35 U.S.C. 154(b) by 186 days.

(21) Appl. No.: 14/938,613

(22) Filed: Nov. 11, 2015

(65) Prior Publication Data

US 2017/0081921 A1 Mar. 23, 2017

Related U.S. Application Data

(60) Provisional application No. 62/222,722, filed on Sep. 23, 2015.

(51) Int. Cl.
*E21B 10/43* (2006.01)
*E21B 10/14* (2006.01)

(52) U.S. Cl.
CPC ..... *E21B 10/43* (2013.01); *E21B 10/14* (2013.01)

(58) Field of Classification Search
CPC ..... E21B 10/00; E21B 10/36; E21B 10/43; E21B 10/42
See application file for complete search history.

(56) References Cited

U.S. PATENT DOCUMENTS

| | | | |
|---|---|---|---|
| 6,298,930 | B1 | 10/2001 | Sinor et al. |
| 8,061,456 | B2 | 11/2011 | Patel et al. |
| 2008/0302573 | A1 | 12/2008 | Sinor et al. |
| 2010/0276200 | A1 | 11/2010 | Schwefe et al. |
| 2011/0155472 | A1 | 6/2011 | Lyons et al. |
| 2011/0192651 | A1 | 8/2011 | Lyons et al. |
| 2012/0080240 | A1 | 4/2012 | Green et al. |
| 2013/0081880 | A1 | 4/2013 | Schwefe et al. |
| 2013/0112485 | A1 | 5/2013 | Richer et al. |
| 2013/0199857 | A1 | 8/2013 | Schwefe et al. |

*Primary Examiner* — Giovanna Collins Wright
*Assistant Examiner* — Manuel C Portocarrero
(74) *Attorney, Agent, or Firm* — TraskBritt

(57) ABSTRACT

An earth-boring tool includes primary and secondary cutting elements mounted to a tool body. The secondary cutting elements define a secondary cutting profile. The secondary cutting profile is recessed relative to the primary cutting profile, which is defined by the primary cutting elements. In an unworn condition, the primary cutting elements engage and cut a formation material while the secondary cutting elements do not. Each secondary cutting element includes a flat surface oriented at an angle relative to a longitudinal axis thereof and extending between a front cutting face and a peripheral side surface thereof. The secondary cutting elements are oriented on the tool body such that a surface area of the flat surface thereof will engage the formation material at least substantially simultaneously when the primary cutting elements reach a worn condition. Methods of forming the earth-boring tool and methods of using the earth-boring tool are also disclosed.

20 Claims, 10 Drawing Sheets

EARTH-BORING TOOL HAVING BACK UP CUTTING ELEMENTS WITH FLAT SURFACES FORMED THEREIN AND RELATED METHODS

CROSS-REFERENCE TO RELATED APPLICATION

The present application claims the benefit of U.S. Provisional Application No. 62/222,722, filed Sep. 23, 2015, entitled "EARTH-BORING TOOL HAVING BACK UP CUTTING ELEMENTS WITH FLAT SURFACES FORMED THEREIN AND RELATED METHODS," which is hereby incorporated by reference in its entirety.

TECHNICAL FIELD

Embodiments of the present disclosure relate to earth-boring tools, such as rotary drill bits, that include cutting elements having a flat surface formed therein, and to methods of manufacturing such earth-boring tools cutting elements.

BACKGROUND

Earth-boring tools are commonly used for forming (e.g., drilling and reaming) bore holes or wells (hereinafter "wellbores") in earth formations. Earth-boring tools include, for example, rotary drill bits, core bits, eccentric bits, bicenter bits, reamers, underreamers, and mills.

Different types of earth-boring rotary drill bits are known in the art including, for example, fixed-cutter bits (which are often referred to in the art as "drag" bits), rolling-cutter bits (which are often referred to in the art as "rock" bits), diamond-impregnated bits, and hybrid bits (which may include, for example, both fixed cutters and rolling cutters). The drill bit is rotated and advanced into the subterranean formation. As the drill bit rotates, the cutters or abrasive structures thereof cut, crush, shear, and/or abrade away the formation material to form the wellbore.

The drill bit is coupled, either directly or indirectly, to an end of what is referred to in the art as a "drill string," which comprises a series of elongated tubular segments connected end-to-end and extends into the wellbore from the surface of the formation. Often various tools and components, including the drill bit, may be coupled together at the distal end of the drill string at the bottom of the wellbore being drilled. This assembly of tools and components is referred to in the art as a "bottom hole assembly" (BHA).

The drill bit may be rotated within the wellbore by rotating the drill string from the surface of the formation, or the drill bit may be rotated by coupling the drill bit to a downhole motor, which is also coupled to the drill string and disposed proximate the bottom of the wellbore. The downhole motor may comprise, for example, a hydraulic Moineau-type motor having a shaft, to which the drill bit is mounted, that may be caused to rotate by pumping fluid (e.g., drilling mud or fluid) from the surface of the formation down through the center of the drill string, through the hydraulic motor, out from nozzles in the drill bit, and back up to the surface of the formation through the annular space between the outer surface of the drill string and the exposed surface of the formation within the wellbore.

Cutting elements often employed in earth-boring tools often include polycrystalline diamond cutters (often referred to as "PDCs"), which are cutting elements that include a polycrystalline diamond (PCD) material. Such polycrystalline diamond cutting elements are formed by sintering and bonding together relatively small diamond grains or crystals under conditions of high temperature and high pressure in the presence of a catalyst (such as, for example, cobalt, iron, nickel, or alloys and mixtures thereof) to form a layer of polycrystalline diamond material on a cutting element substrate. These processes are often referred to as high temperature/high pressure (or "HTHP") processes. The cutting element substrate may comprise a cermet material (i.e., a ceramic-metal composite material) such as, for example, cobalt-cemented tungsten carbide. In such instances, the cobalt (or other catalyst material) in the cutting element substrate may be drawn into the diamond grains or crystals during sintering and serve as a catalyst material for forming a diamond table from the diamond grains or crystals. In other methods, powdered catalyst material may be mixed with the diamond grains or crystals prior to sintering the grains or crystals together in an HTHP process.

PDC cutting elements commonly have a planar, disc-shaped diamond table on an end surface of a cylindrical cemented carbide substrate. Such a PDC cutting element may be mounted to a body of an earth-boring tool in a position and orientation that causes a peripheral edge of a front cutting face of the diamond table to scrape against and shear away the surface of the formation being cut as the tool is rotated within a wellbore. As the PDC cutting element wears, a so-called "wear scar" or "wear flat" develops that comprises a generally flat surface of the cutting element that ultimately may extend from the front cutting face of the diamond table to the cylindrical peripheral side surface of the cemented carbide substrate. As the surface area of the wear flat increases, additional weight-on-bit (WOB) is required to maintain a given depth of cut. Eventually, the cutting elements reach a sufficiently worn condition that the tool is deemed to be dull, and the tool must be removed from the wellbore and repaired and/or replaced. If drilling is continued with a dull tool, the tool may be damaged beyond repair.

BRIEF SUMMARY

Various embodiments of the present disclosure comprise an earth-boring tool for forming a wellbore in a subterranean formation. The earth-boring tool may comprise a tool body and cutting elements mounted thereto. The cutting elements may comprise primary cutting elements defining a primary cutting profile of the earth-boring tool and secondary cutting elements defining a secondary cutting profile recessed relative to the primary cutting profile. The secondary cutting profile may be recessed such that, upon initial cutting action of the earth-boring tool in an unworn condition, the primary cutting elements will engage and cut a formation material while the secondary cutting elements do not engage and cut the formation material. The secondary cutting profile may further be recessed such that the secondary cutting elements will engage the formation material only after the primary cutting elements reach a worn condition. Each secondary cutting element may comprise a flat surface oriented at an angle relative to a longitudinal axis of the secondary cutting element and extending between a front cutting face and a peripheral side surface of the secondary cutting element. The secondary cutting element may be oriented such that a surface area of the flat surface of the secondary cutting element will engage the formation material at least substantially simultaneously.

Other embodiments of the present disclosure comprise a method of forming an earth-boring tool for forming a wellbore in a subterranean formation. Such a method may include mounting primary cutting elements and secondary cutting elements on a tool body. The primary cutting elements may be located and oriented so as to define a primary cutting profile of the earth-boring tool. The secondary cutting elements may be located and oriented to define a secondary cutting profile recessed relative to the primary cutting profile such that, upon initial cutting action of the earth-boring tool in an unworn condition, the primary cutters will engage and cut a formation material while the secondary cutting elements do not engage and cut the formation material. The secondary cutting elements may be located and oriented to define a secondary cutting profile recessed relative to the primary cutting profile such that the secondary cutting elements will engage the formation material only after the primary cutting elements reach a worn condition. Each secondary cutting element may comprise a flat surface oriented at an angle relative to a longitudinal axis of the secondary cutting element and extending between a front cutting face and a peripheral side surface of the secondary cutting element. The secondary cutting element may be oriented such that the surface area of the flat surface of the secondary cutting element will engage the formation material at least substantially simultaneously.

Other embodiments of the present disclosure comprise a method for forming a wellbore in a subterranean formation. Such a method may include disposing an earth-boring tool for forming a wellbore in a subterranean formation. The method may include engaging the subterranean formation with primary cutting elements on a tool body of the earth-boring tool and without engaging the subterranean formation with secondary cutting elements on the tool body. The primary cutting elements may be located and oriented so as to define a primary cutting profile of the earth-boring tool and the secondary cutting elements are located and oriented to define a secondary cutting profile recessed relative to the primary cutting profile. Each of the secondary cutting elements may comprise a flat surface oriented at an angle relative to a longitudinal axis of the secondary cutting element and extending between a front cutting face and a peripheral side surface of the secondary cutting element. Each secondary cutting element may be oriented such that a surface area of the flat surface of the respective secondary cutting element will engage the subterranean formation at least substantially simultaneously. The method may include rotating the earth-boring tool within the wellbore and cutting a formation material with the primary cutting elements and wearing the primary cutting elements. After wearing the primary cutting elements to a worn condition, the method may include engaging the subterranean formation with the secondary cutting elements. The method may include detecting the engagement of the subterranean formation with the secondary cutting elements at a surface of the formation and removing the earth-boring tool from the wellbore before the earth-boring tool is damaged beyond repair.

DETAILED DESCRIPTION

The illustrations presented herein are not meant to be actual views of any particular earth-boring tool or component thereof, but are merely idealized representations that are employed to describe example embodiments of the disclosure. Elements common between figures may retain the same numerical designation.

Figure 1:
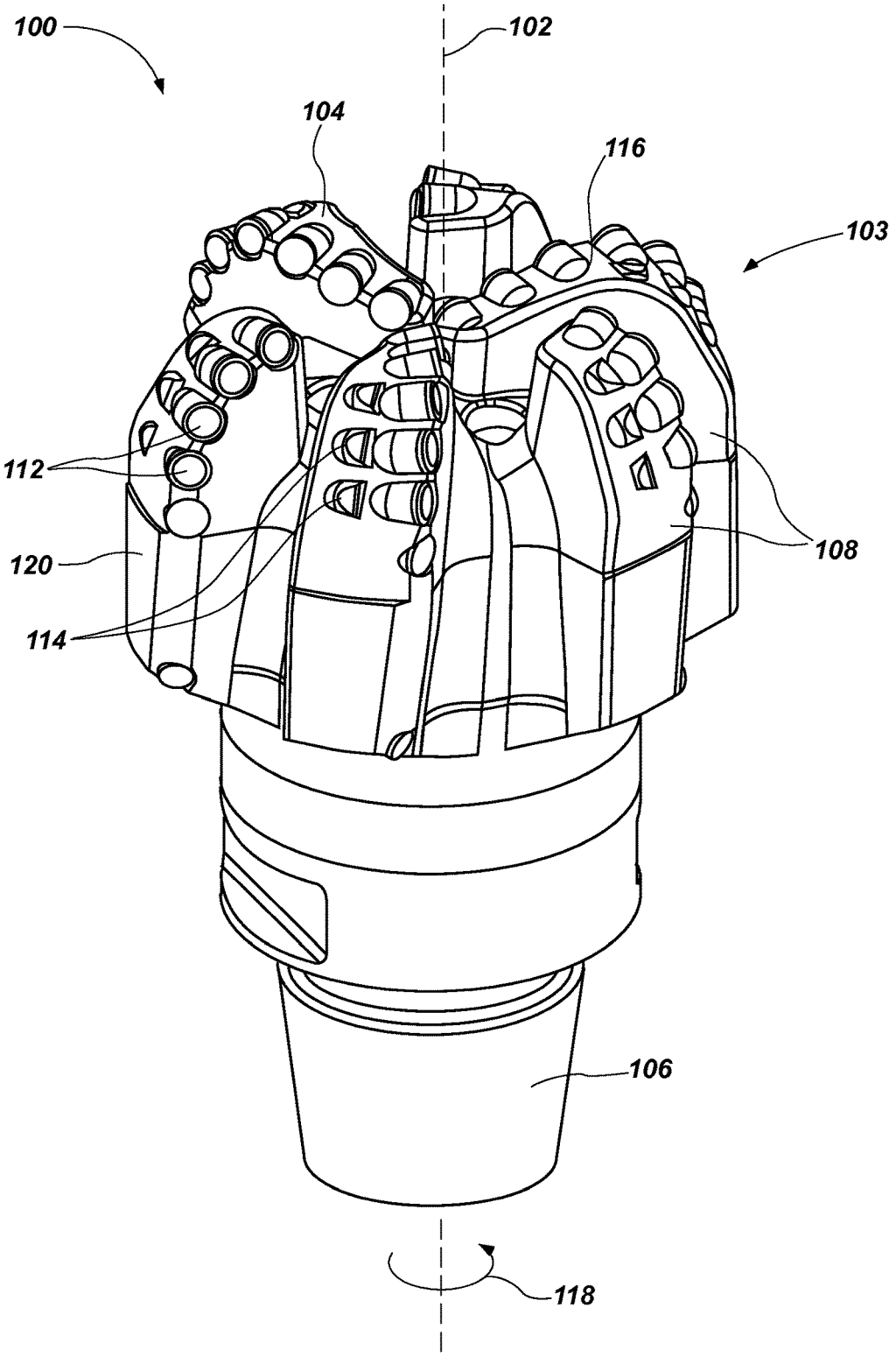
FIG. 1 illustrates an isometric view of an earth-boring rotary drill bit according to an embodiment of the present disclosure.

FIG. 1 illustrates an isometric view of a rotary drill bit 100 according to some embodiments of the present disclosure. The rotary drill bit 100 may have a longitudinal axis 102, a crown 103, a shank 106, and a plurality of blades 108 disposed in a cutting portion of the drill bit 100. The longitudinal axis 102 represents a vertical axis (from the perspective of the figure), conventionally the center line of the bit 100, about which the drill bit 100 rotates. The shank 106 may be attached to or coupled to the crown 103 and may comprise an opposing end having threads configured for attachment to a drill string (not shown).

Cutting elements 112, 114 may be mounted on a tool body 104. In some embodiments, the cutting elements 112, 114 may be disposed in pockets 116 formed in a surface of the blades 108. The cutting elements 112, 114 may be coupled to the blades 108 and within the pockets 116 thereof by welding, brazing, and adhering using a high-strength adhesive. In operation, the drill bit 100 may rotate in a direction as indicated by an arrow 118.

The secondary cutting elements 114 may comprise backup cutting elements that are positioned to "back up" the primary cutting elements 112. A backup cutting element is a cutting element that may be located at substantially the same radial and longitudinal position on a drill bit as another cutting element (i.e., a primary cutting element), such that the backup cutting element follows the kerf cut by the primary cutting element. In other words, the backup cutting element at least substantially follows the same cutting path as the corresponding primary cutting element during a drilling operation. The backup cutting element may be in a rotationally trailing position compared to the corresponding leading primary cutting element. Corresponding backup cutting elements and primary cutting elements may be disposed on different blades, or they may be disposed on the same blade.

Figure 2:
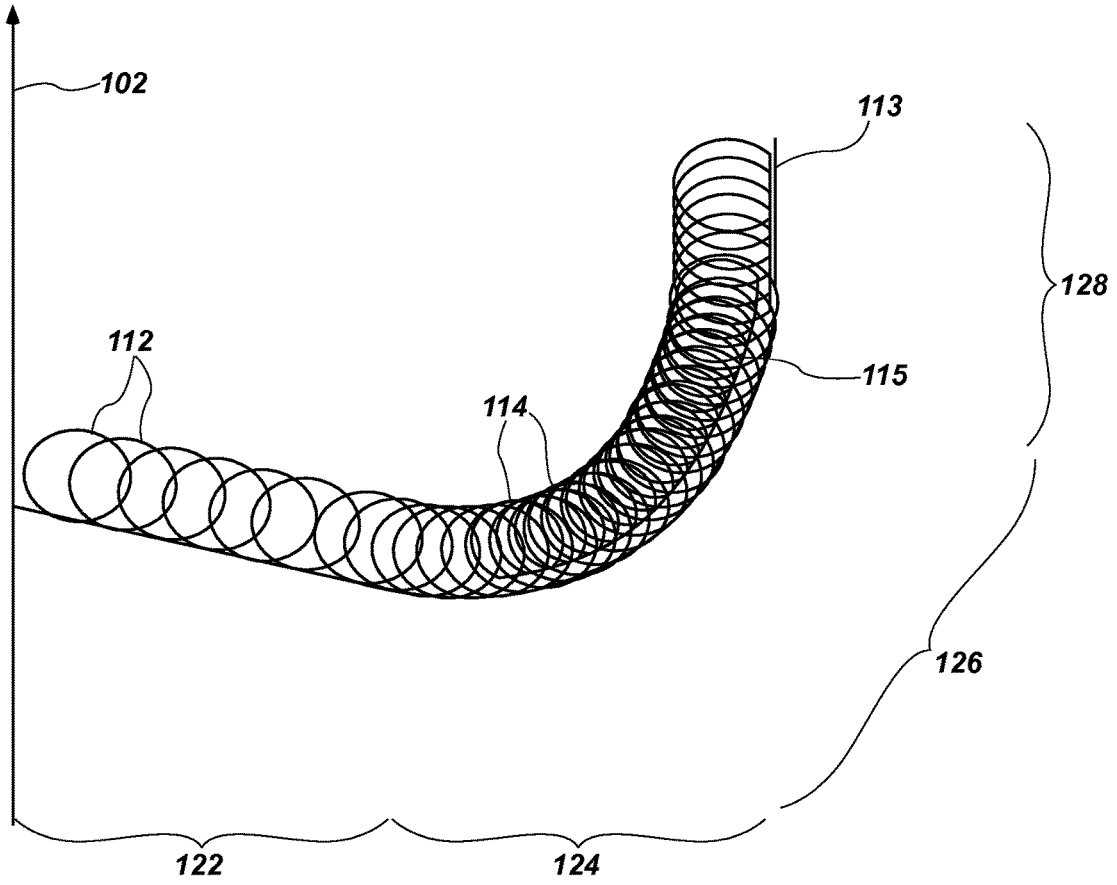
FIG. 2 illustrates a diagram of primary and secondary cutting element profiles of the drill bit of FIG. 1.

FIG. 2 is a cutting element profile of the drill bit 100 shown in FIG. 1. The cutting element profile illustrates the position of each of the cutting elements 112, 114 rotated into a single plane. The cutting element profile may extend from a center line of the tool body 104 (e.g. the longitudinal axis 102) to the gage 120 (FIG. 1). The distance from the cutting elements 112, 114 to the longitudinal axis 102 corresponds to the radial position of that cutting element on the drill bit 100.

Cutting elements 112, 114 may be positioned along a selected cutting profile. The primary cutting elements 112 may define a primary cutting profile 113. The secondary cutting elements 114 may define a secondary cutting profile 115. The secondary cutting profile 115 may be recessed relative to the primary cutting profile 113 such that, upon initial cutting action of an earth-boring tool, the primary cutting elements 112 may engage and cut formation material while the secondary cutting elements 114 do not engage and cut formation material. The secondary cutting elements 114 may engage the formation material only after the primary cutting elements 112 reach a worn condition. The worn condition of the primary cutting elements 112 at which the secondary cutting elements 114 may engage the formation material may be an at least substantially dull condition of the primary cutting elements 112.

In some embodiments, the secondary cutting profile 115 may be recessed relative to the primary cutting profile 113 by a constant underexposure value, such that each secondary cutting element 114 is recessed relative to each primary cutting element 112 by a substantially equal distance. In yet other embodiments, the secondary cutting profile 115 may be recessed relative to the primary cutting profile 113 by a variable underexposure value. By way of example and not limitation, the primary cutting elements 112 may wear at different rates and reach a worn condition at different times depending on the region of the drill bit 100 in which each primary cutting element 112 is mounted. In order for the secondary cutting elements 114 to engage the formation material at substantially the same time (i.e., when the primary cutting elements 112 reach a worn condition), each secondary cutting element 114 may be recessed relative to a corresponding primary cutting element 112 by a different distance depending upon the region in when the corresponding primary and secondary cutting elements 112, 114 are mounted to the tool body 104. In some embodiments, the secondary cutting profile 115 may be recessed relative to the primary cutting profile 113 by an average distance of at least about 1.0 mm, at least about 2.0 mm, or even at least about 4.0 mm. In one non-limiting example, the secondary cutting profile 115 may be recessed relative to the primary cutting profile 113 by an average distance of about 2.54 mm.

As known in the art, the cutting portion of a drill bit 100 like that shown in FIGS. 1 and 2 may comprise a plurality of regions between the central longitudinal axis 102 of the bit 100 and the gage 120 surfaces of the drill bit 100. These regions include a central cone region 122 having the shape of an inverted cone, a nose region 124 (which includes the most distal surfaces on the face of the drill bit 100), a shoulder region 126, and a gage region 128 (which includes the gage 120 surfaces of the drill bit 100).

Figure 9:
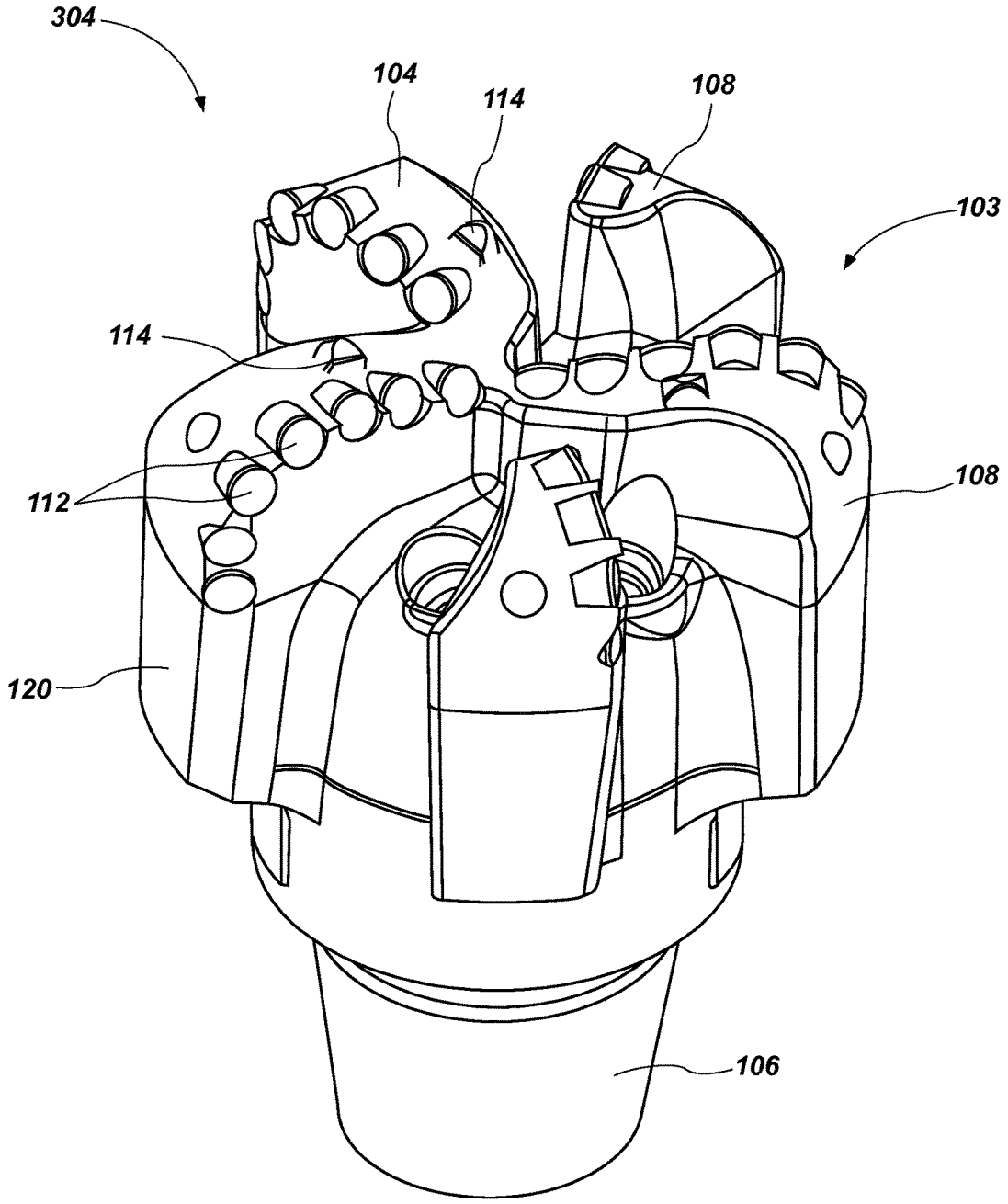
FIG. 9 illustrates an isometric view of another earth-boring rotary drill bit according to an embodiment of the present disclosure.

The primary cutting elements 112 may be mounted to and coupled to the tool body 104 (FIG. 1) in any of the cone region 122, the nose region 124, the shoulder region 126, and the gage region 128. In some embodiments, the secondary cutting elements 114 may be mounted to and coupled to the tool body 104 in each of the nose region 124, the shoulder region 126, and the gage region 128, as shown in FIG. 2. In other embodiments, the secondary cutting elements 114 may be additionally or alternatively mounted and coupled to the tool body 104 in the cone region 122, as shown in FIG. 9.

Figure 3:
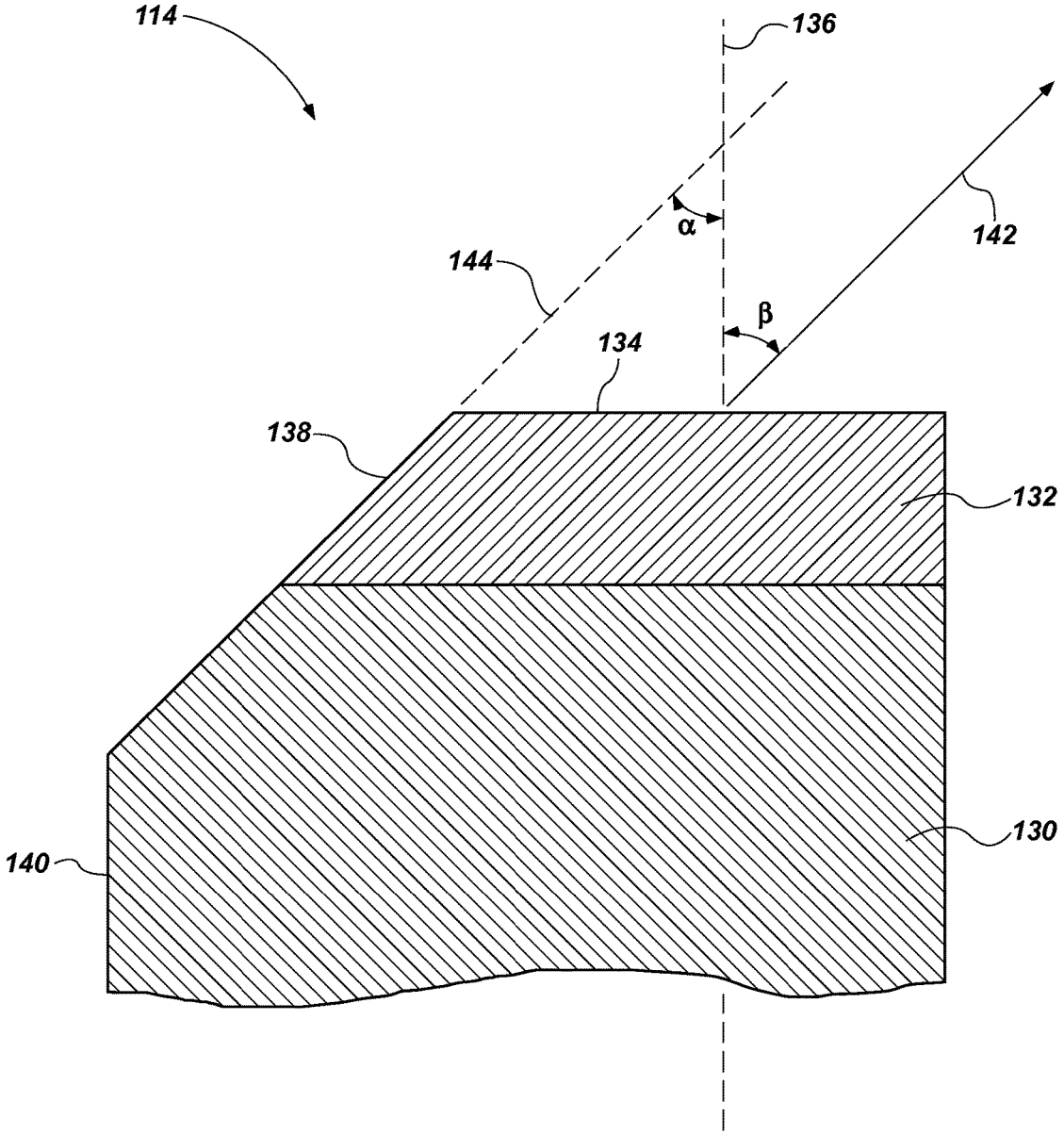
FIG. 3 illustrates a partial, cross-sectional side view of a secondary cutting element of the drill bit of FIG. 1.

Each of the cutting elements 112, 114 may be PDC cutting elements. However, it is recognized that any other suitable type of cutting element may be utilized. The cutting elements 112, 114 may comprise a supporting substrate 130 having a diamond table 132 thereon (FIG. 3). The diamond table 132 may be formed on the supporting substrate 130, or the diamond table 132 and the supporting substrate 130 may be separately formed and subsequently attached together. The cutting elements 112, 114 may remove material from the underlying subterranean formation by a shearing action as the drill bit 100 is rotated in the direction indicated by arrow 118 (FIG. 1) and by contacting the formation material with cutting surfaces of the cutting elements 112, 114.

FIG. 3 illustrates a cross-sectional side view of a secondary cutting element 114. The secondary cutting element 114 may have a peripheral side surface 140 having a generally cylindrical shape. The secondary cutting element 114 may comprise a supporting substrate 130 and a diamond table 132 as previously described. The diamond table 132 may comprise a front cutting face 134, which may be planar or non-planar. The front cutting face 134 may be substantially planar in some embodiments, and may be oriented substantially transverse to a longitudinal axis 136 of the secondary cutting element 114. A flat surface 138 may be formed at the cutting edge of the secondary cutting element 114 defined by the periphery of the front cutting face 134 of the diamond table 132. The flat surface 138 may be characterized as a pre-formed blunt cutting surface. Viewed in the plane of FIG. 3, the flat surface 138 may also extend longitudinally through a corner portion of each of the diamond table 132 and the supporting substrate 130 and may extend between, and intersect each of, the front cutting face 134 and the peripheral side surface 140 of the cutting element 114.

A cutting direction as indicated by directional arrow 142 is shown in FIG. 3. A line 144 may be defined as a line that is tangent to a plane of the flat surface 138. As illustrated in FIG. 3, the line 144 intersects the longitudinal axis 136 of the secondary cutting element 114. The flat surface 138 may be formed at an acute angle $\alpha$ relative to the longitudinal axis 136 of the secondary cutting element 114. Alternatively or additionally, the angle of the flat surface 138 may be measured as the angle $\alpha$ between the line 144 and longitudinal axis 136.

In some embodiments, the secondary cutting element 114 may be mounted on the tool body 104 such that the flat surface 138 may be oriented in a plane substantially parallel to the cutting direction 142. As a result, the angle $\alpha$ may be related to an angle $\beta$. The angle $\beta$ may be measured between the longitudinal axis 136 and the cutting direction 142. As non-limiting examples, the angle $\alpha$ may be within about 15% of the angle $\beta$, the angle $\alpha$ may be within about 10% of the angle $\beta$, or the angle $\alpha$ may be within about 5% of the angle α. In some embodiments, the angle α may be at least substantially equal to (i.e., substantially congruent to) the angle β.

Figure 4:
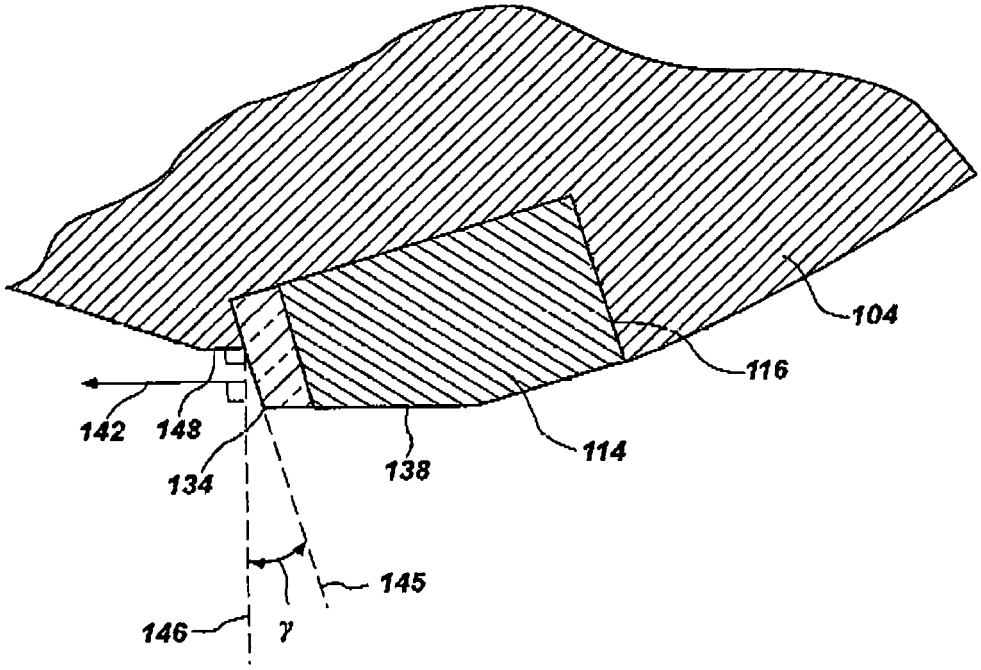
FIG. 4 illustrates a partial, cross-sectional side view of a portion of a blade of the drill bit of FIG. 1 including a secondary cutting element.

FIG. 4 is a cross-sectional side view of a secondary cutting element 114 mounted to the tool body 104 of the rotary drill bit 100 of FIG. 1. The secondary cutting element 114 may be positioned within a pocket 116 on a blade 108 of the drill bit 100. A cutting direction is represented by directional arrow 142. The cutting element 114 may be mounted on the tool body 104 in an orientation such that the front cutting face 134 of the cutting element 114 is oriented at a back rake angle γ with respect to a line 146. The line 146 may be defined as a line that extends (in the plane of FIG. 4) radially outward from an outer surface 148 of the tool body 104 of the drill bit 100 in a direction substantially perpendicular to the outer surface 148 at the location of the cutting element 114. Additionally or alternatively, the line 146 may be defined as a line that extends (in the plane of FIG. 4) radially outward from the outer surface 148 of the tool body 104 in a direction substantially perpendicular to the cutting direction as indicated by directional arrow 142. The back rake angle γ may be measured relative to the line 146, positive angles being measured in the counter-clockwise direction, negative angles being measured in the clockwise direction. Additionally or alternatively, the back rake angle γ may be measured as the angle between the line 146 and a tangent line 145. The tangent line 145 may be tangent to a plane of the front cutting face 134 of the cutting element 114 and perpendicular to the longitudinal axis 136 of the cutting element 114 (FIG. 3). In some embodiments, the angle α at which the flat surface 138 is oriented relative to the longitudinal axis 136 of the secondary cutting element 114 may be at least substantially equal to (i.e., substantially congruent to) the back rake angle γ of the secondary cutting element 114. With continued reference to FIGS. 3 and 4, each of the angles α, β, and γ may be at least substantially equal (i.e., substantially congruent). In some embodiments, each of the angles α, β, and γ may be in a range extending from about five degrees 5°) to about forty degrees (40°), or, more particularly, from about fifteen degrees (15°) to about twenty-five degrees (25°).

With continued reference to FIGS. 3 and 4, the secondary cutting element 114 may be mounted to the tool body 104 such that the flat surface 138 is oriented parallel to a plane tangent to the outer surface 148 of the tool body 104 at a location at which the secondary cutting element 114 is mounted to the tool body 104. The secondary cutting element 114 may be mounted to the tool body 104 such that a portion of the secondary cutting element 114, including a portion of the front cutting face 134 and the flat surface 138, may extend (longitudinally and radially project) above the outer surface 148 of the tool body 104 at a location at which the secondary cutting element 114 is mounted. While a portion of the secondary cutting element 114 extends above the outer surface 148, the cutting element 114 may be underexposed (e.g., recessed in comparison to a corresponding primary cutting element 112) and configured to engage formation material after a corresponding primary cutting element 112 has reached a worn condition, as described with reference to FIG. 2 and further with reference to FIGS. 6 and 7.

Figure 5:
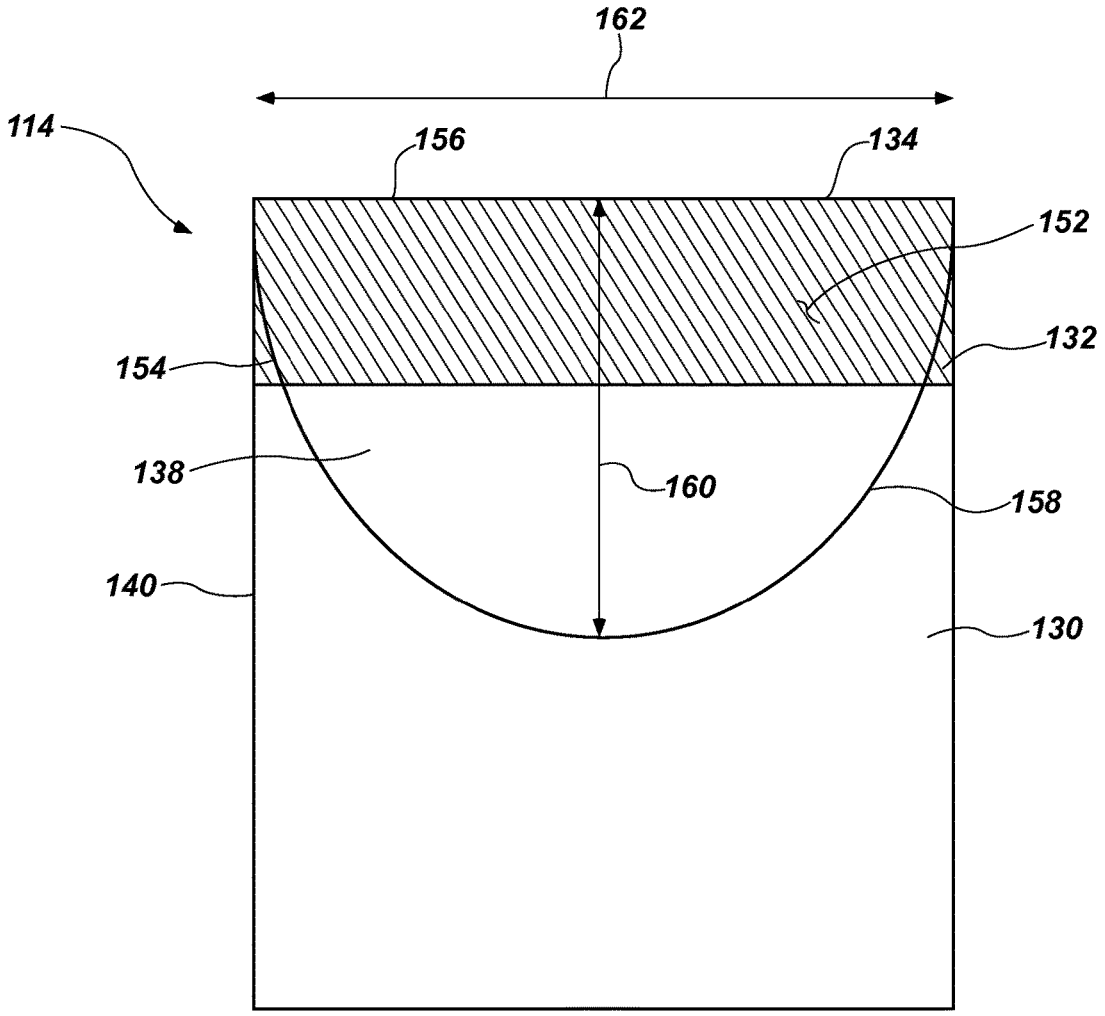
FIG. 5 illustrates a side view of a secondary cutting element of the drill bit of FIG. 1.

FIG. 5 is a side view of the secondary cutting element 114 illustrating the flat surface 138. A surface area 152 of the flat surface 138 may be defined by a perimeter 154 of the flat surface 138. The surface area 152 may be formed such that, when the secondary cutting element 114 engages the formation material, the surface area 152 may engage the formation material at least substantially simultaneously. The surface area 152 may have a generally semi-elliptical shape. The perimeter 154 may have a straight portion 156 and an arcuate portion 158. The straight portion 156 may be formed generally at the front cutting face 134 of the secondary cutting element 114. The arcuate portion 158 may extend through the peripheral side surface 140 of the secondary cutting element 114 and may extend through the diamond table 132 and the supporting substrate 130. The surface area 152 may have a maximum length 160 measured from the straight portion 156 at the front cutting face 134 to the arcuate portion 158. The surface area 152 may have a maximum width 162 perpendicular to the maximum length 160. The maximum width 162 of the surface area 152 may be located at the front cutting face 134 of the secondary cutting element 114 in some embodiments. The maximum width 162 may be at least substantially equal to a diameter of the secondary cutting element 114 in some embodiments. In other embodiments, the maximum width 162 may be less than a diameter of the secondary cutting element 114. In some embodiments, the maximum length 160 may be greater than the maximum width 162.

In some embodiments, the flat surface 138 may be formed by removing material comprising each of the diamond table 132 and the supporting substrate 130 subsequent to the diamond table 132 being formed over or attached to the supporting substrate 130. Methods of removing material of the diamond table 132 and the supporting substrate 130 may include electronic discharge machining (EDM), grinding, and/or machining. In some embodiments, the flat surface 138 may be formed in the secondary cutting element 114 prior to the secondary cutting element 114 being mounted to the tool body 104. In other embodiments, the flat surface 138 may be formed in the secondary cutting element 114 subsequent to the secondary cutting element 114 being mounted to the tool body 104 and prior to disposing an earth-boring tool in a subterranean formation to form a wellbore therein.

In some embodiments, methods of forming an earth-boring tool for forming a wellbore in a subterranean formation may comprise mounting the primary cutting elements 112 on the tool body 104. The primary cutting elements 112 may be located and oriented so as to define a primary cutting profile 113 of the earth-boring tool. The method may also comprise mounting the secondary cutting elements 114 on the tool body 104. The secondary cutting elements 114 may be located and oriented so as to define the secondary cutting profile 115. The secondary cutting profile 115 may be recessed relative to the primary cutting profile 113 such that, upon initial cutting action of the earth-boring tool in an unworn condition, the primary cutting elements 112 may engage and cut the formation material while the secondary cutting elements 114 do not engage and cut formation material, and such that the secondary cutting elements 114 may engage the formation material only after the primary cutting elements 112 reach a worn condition. The worn condition of the primary cutting elements 112 at which the secondary cutting elements 114 may engage the formation material is an at least substantially dull condition of the primary cutting elements 112.

In some embodiments, additional secondary cutting elements may be mounted to the tool body 104. The additional secondary cutting elements may not include flat surfaces oriented at an angle relative to the longitudinal axes of the additional secondary cutting elements and extending between front cutting faces and peripheral side surfaces of the additional secondary cutting elements. The additional secondary cutting elements may define an additional cutting profile that may be recessed relative to the primary cutting profile 113 but may not be recessed relative to the secondary cutting profile 115. The additional secondary cutting elements may be generally similar to primary cutting elements 112 as described with reference to FIG. 6.

Figure 6:
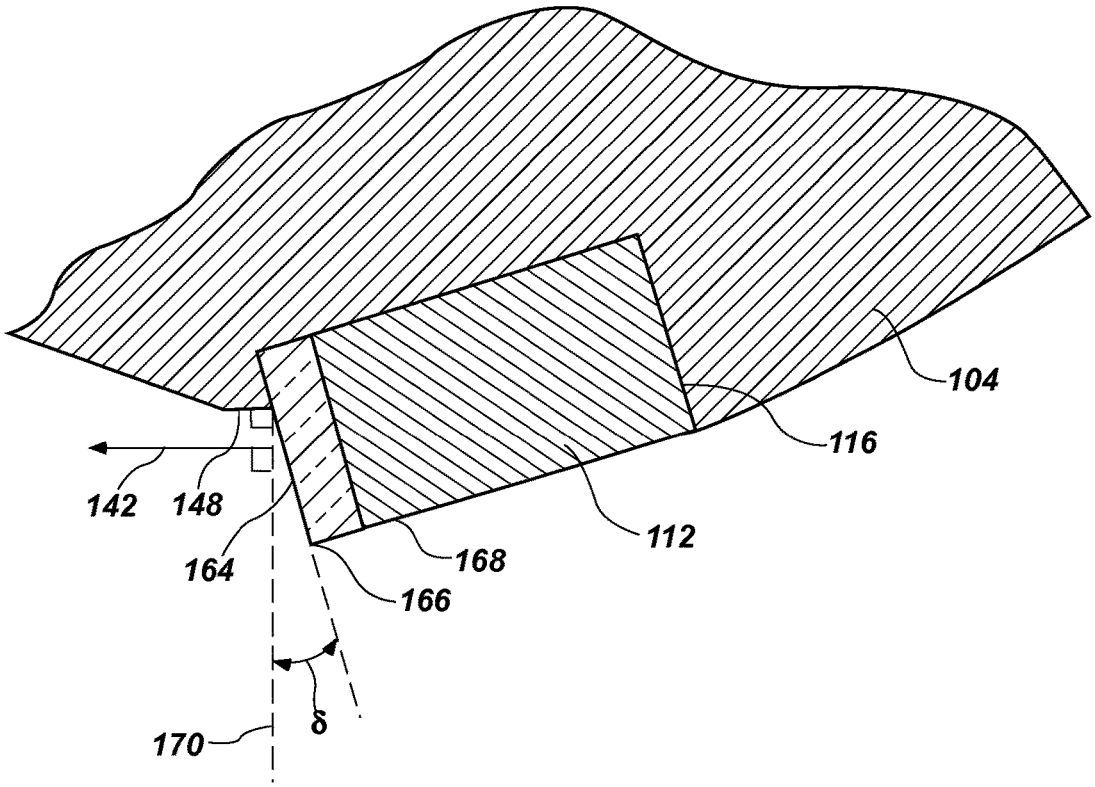
FIG. 6 illustrates a partial, cross-sectional side view of a portion of a blade of the drill bit of FIG. 1 including a primary cutting element.

FIG. 6 is a cross-sectional side view of a primary cutting element 112 in an unworn condition and mounted to the tool body 104 of the drill bit 100 (FIG. 1). The primary cutting element 112 may be positioned within the pocket 116 on the blade 108 (FIG. 1). The primary cutting element 112 may be in a rotationally leading position relative to the corresponding secondary cutting element 114 as previously described with reference to FIG. 1. The primary cutting elements 112 may be configured generally similar to the secondary cutting elements 114 described in reference to FIGS. 3 through 5, wherein, instead of having a flat surface 138, the primary cutting element 112 in the embodiment of FIG. 6 may have a front cutting face 164 and an aggressive cutting edge 166 on a leading portion of the primary cutting element 112. The cutting edge 166 may define an uppermost cutting surface of the cutting element 112 as the cutting element 112 shears away formation material to form a wellbore in a subterranean formation. The cutting edge 166 may also define an intersection between the front cutting face 164 and a peripheral side surface 168 of the primary cutting element 112.

The primary cutting element 112 may be mounted at a back rake angle δ with respect to a line 170. The line 170 may be defined as a line that extends (in the plane of FIG. 6) radially outward from an outer surface 148 of the tool body 104 of the drill bit 100 in a direction substantially perpendicular thereto at that location. Additionally or alternatively, the line 170 may be defined as a line that extends (in the plane of FIG. 6) radially outward from the outer surface 148 of the tool body 104 in a direction substantially perpendicular to the cutting direction as indicated by directional arrow 142. The back rake angle δ may be measured relative to the line 170, positive angles being measured in the counter-clockwise direction, negative angles being measured in the clockwise direction. In some embodiments, the back rake angle δ may be at least substantially the same as the angle α and the back rake angle γ of the secondary cutting element 114. In other embodiments, the back rake angle δ may be less than or greater than the back rake angle γ.

Embodiments of earth-boring tools that include cutting elements 112, 114 fabricated as described herein may be used to form a wellbore in a subterranean formation. In some embodiments, a method of using the earth-boring tool may comprise disposing the earth-boring tool for forming a wellbore in a subterranean formation in an unworn condition. The earth-boring tool may comprise primary cutting elements 112 and secondary cutting elements 114 as disclosed according to some embodiments of the present disclosure. The earth-boring tool may be rotated within the wellbore thereby cutting formation material with the primary cutting elements 112 and wearing the primary cutting elements 112. After wearing the primary cutting elements 112 to a worn condition, the earth-boring tool engages the subterranean formation with the secondary cutting elements 114. The engagement of the subterranean formation with the secondary cutting elements 114 may be detected at a surface of the subterranean formation and the earth-boring tool removed from the wellbore before the earth-boring tool is damaged beyond repair (DBR).

As the primary cutting elements 112 dull and progress to a worn condition, a rate of penetration (ROP) of the drill bit 100 decreases. A decreased ROP is a manifestation that the primary cutting elements 112 are wearing out, particularly when other drilling parameters remain constant. The ROP may be measured at a surface of the formation. Additionally or alternatively, the weight-on-bit (WOB) required to maintain a given ROP increases as the primary cutting elements 112 dull and progress to a worn condition. Eventually, the primary cutting element 112 may become appreciably worn and reach the worn condition at which the secondary cutting elements 114 engage with and begin to cut the formation material concurrently with the primary cutting elements 112.

Figure 7:
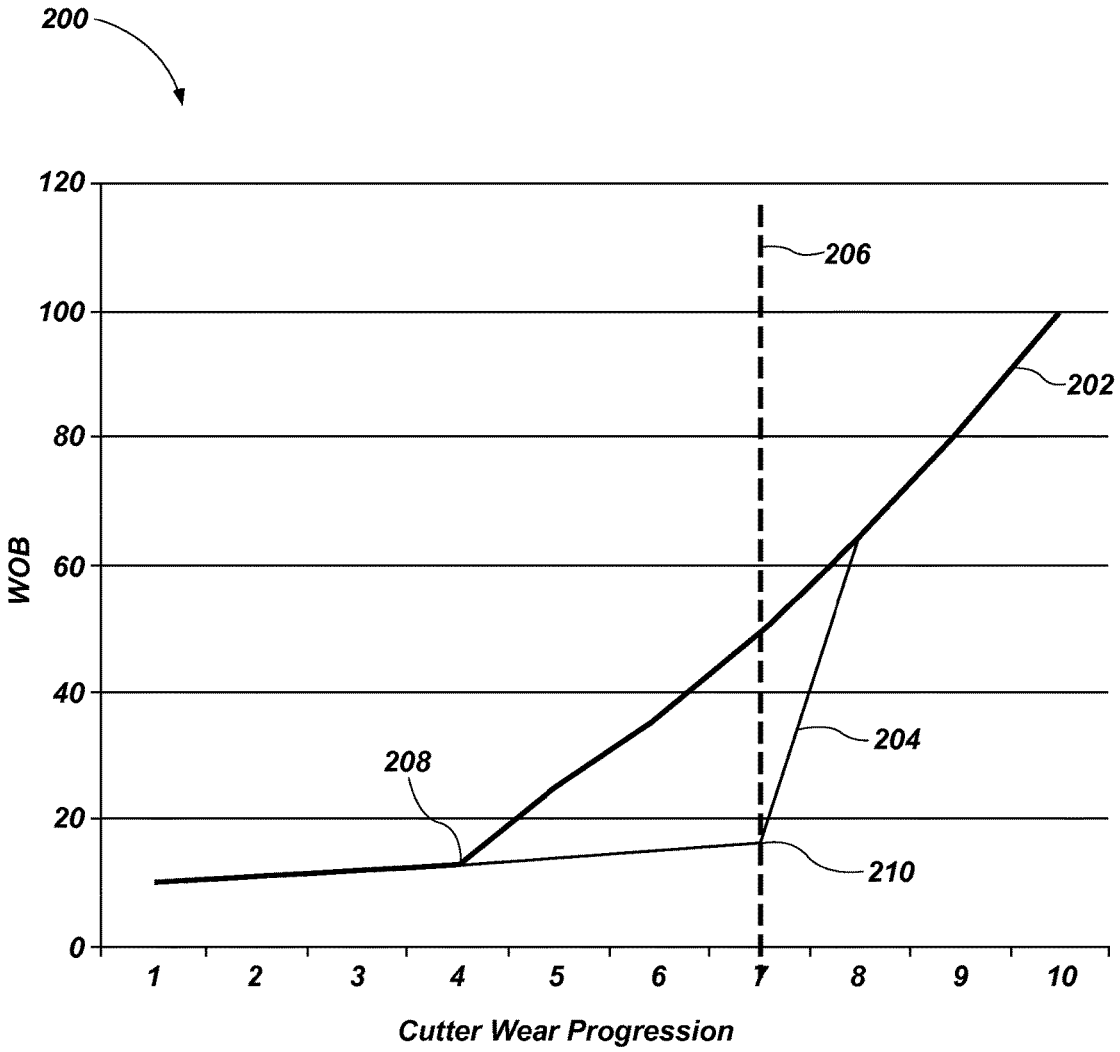
FIG. 7 is a graph illustrating the relationship between a weight-on-bit required to maintain a given rate-of-penetration and wear progression of cutting elements mounted to a drill bit for both a conventional drill bit and a drill bit according to some embodiments of the present disclosure.

FIG. 7 is a graph 200 of the relationship between the WOB required to maintain a given ROP for a drill bit and the wear progression of cutting elements on the drill bit. Curve 202 illustrates the relationship for a conventional drill bit having conventional secondary backup cutting elements, and curve 204 illustrates the relationship for a drill bit 100 having the cutting elements 112, 114 thereon, as described herein.

The conventional drill bit comprises backup cutting elements lacking a flat surface as previously described with reference to FIGS. 3 through 5. In the conventional drill bit, the backup cutting elements are mounted to the drill bit and underexposed in comparison to the primary cutting elements. The backup cutting elements may comprise an aggressive cutting edge at the periphery of the cutting face, which engages the formation material after a given amount of wear of the primary cutting elements. Curve 204 illustrates the WOB required to maintain a given ROP for the drill bit 100 as wear progresses on the cutting elements 112, 114 thereon. A line 206 indicates a level of wear of the cutting elements on the drill bits beyond which the drill bit risks being damaged beyond repair, and at which it would be desirable to cease drilling operations and remove the drill bit from the subterranean formation to prevent the drill bit from being damaged beyond repair.

Referring to the curve 202, initially, only the primary cutting elements engage the formation and wear. As wear on the primary cutting elements progresses, the WOB required to maintain a given ROP increases as the wear flats on the primary cutting elements increase in size. As previously described, after the primary cutting elements become appreciably worn, the conventional secondary cutting elements engage with the subterranean formation at the location 208 on the graph. When the secondary cutting elements engage the subterranean formation, the WOB required to maintain the given ROP increases at a higher rate with the wear progression to the additional bearing surface area provided by the wear flats of the secondary cutting elements. As can be seen in FIG. 7, there is no manifestation along the curve 202 at a point of intersection with the line 206 indicating that the drill bit and the cutting elements thereon have progressively worn such that the drill bit risks being damaged beyond repair. As a result, the drilling operator risks damaging the drill bit beyond repair.

Referring to the curve 204, initially, only the primary cutting elements 112 engage the formation and wear. As wear on the primary cutting elements 112 progresses, the WOB required to maintain a given ROP increases as the wear flats on the primary cutting elements 112 increase in size. As previously described, after the primary cutting elements 112 reach a worn condition, the secondary cutting elements 114 may engage the subterranean formation. When the secondary cutting elements 114 engage the subterranean formation at the location 210, the WOB required to maintain the given ROP increases at a significantly higher rate, due to the bearing surface area provided by the flat surfaces formed on the secondary cutting elements 114. The secondary cutting elements 114 are recessed to a degree selected such that the location 210 at which the cutting elements 114 engage the formation coincides with the line 206, which is the level of wear of the cutting elements 112 on the drill bit 100 beyond which the drill bit 100 risks being damaged beyond repair. The dramatic increase in WOB required to maintain ROP will be manifest to the drilling operator at the surface of the formation, and will signal the drilling operator to remove the drill bit 100 from the wellbore.

The invention is not limited to the exact details of construction, operation, exact materials, or embodiments shown and described, as modifications and equivalents will be apparent to one skilled in the art. For example, the cutting elements herein described have applicability on other earth-boring tools that include fixed cutting elements, such as reamers and so-called "hybrid" drill bits incorporating both roller cone cutters and fixed cutting elements. Any and all such earth-boring rotary drilling tools for use downhole are encompassed herein by the term "drill bit."

Figure 8:
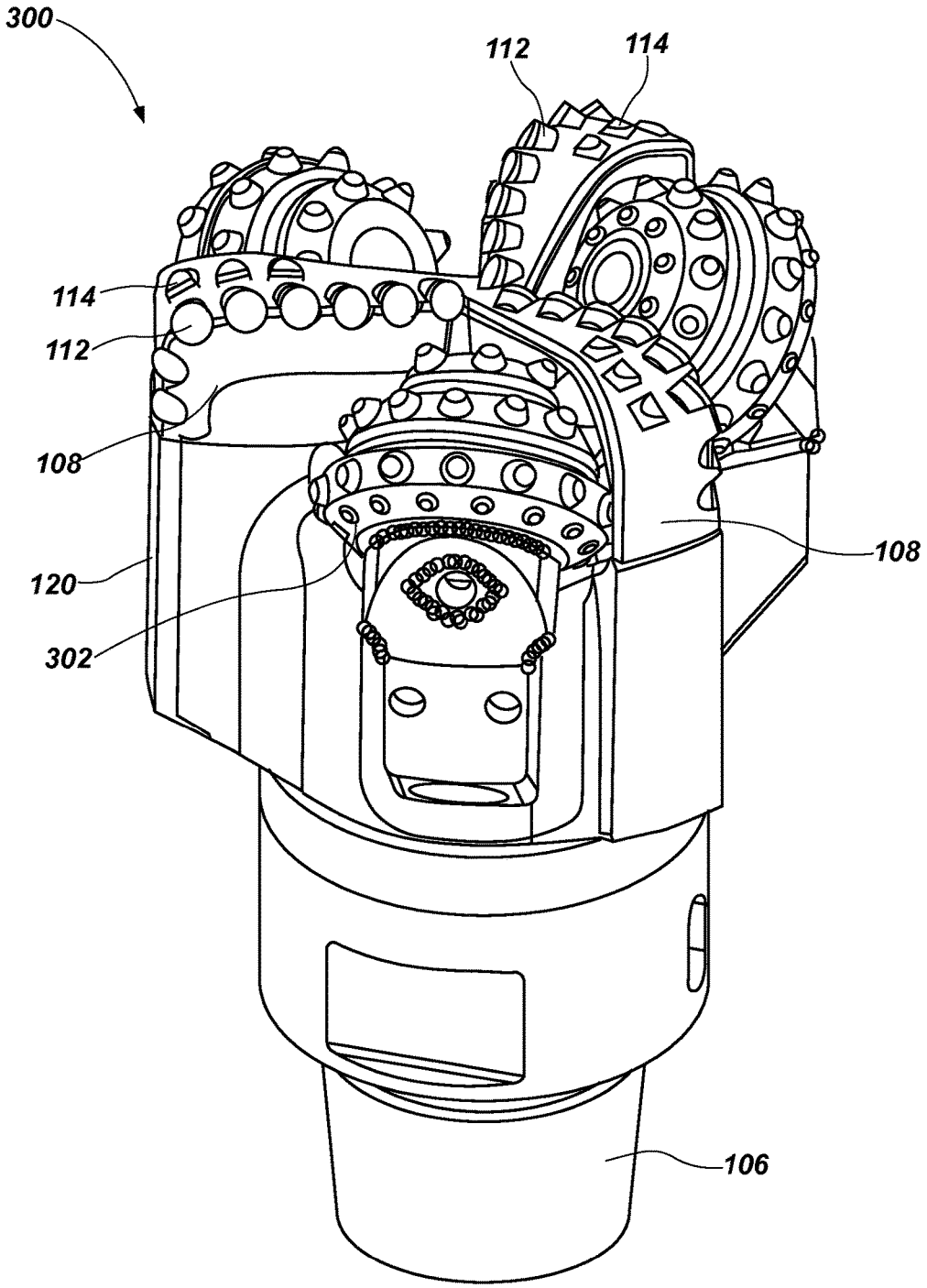
FIG. 8 illustrates an isometric view of a hybrid drill bit according to an embodiment of the present disclosure.

Additional earth-boring tools that may include the cutting elements described herein are illustrated in FIGS. 8 and 9. In some embodiments, the secondary cutting elements 114 may be oriented inline, offset, or staggered, or a combination thereof, for example, without limitation, relative to each of their respective primary cutting elements 112 as shown, for example, in FIGS. 8 and 9. FIG. 8 illustrates an isometric view of a hybrid bit 300 such as a KYMERA™ drill bit commercially available form Baker Hughes, a GE company of Houston, Tex. The hybrid bit 300 may comprise fixed blades 108 and roller cones 302. Fixed blades 108 may comprise primary cutting elements 112 and secondary cutting elements 114 as described herein. The primary cutting elements 112 may be mounted to the blades 108 in each of the cone region, nose region, shoulder region, and gage region thereof. The secondary cutting elements 114 may be mounted in, for example, the nose region and shoulder region thereof.

FIG. 9 illustrates an isometric view of a drill bit 304. The drill bit 304 may comprise fixed blades 108 comprising primary cutting elements 112 and secondary cutting elements 114 according to some embodiments of the present disclosure. The secondary cutting elements 114 may not be backup cutting elements, in the sense that they are not located at the same longitudinal and radial position as any corresponding primary cutting element 112. Alternatively or additionally, the secondary cutting elements 114 may not be backup cutting elements, in the sense that they are not located in a rotationally trailing position to the primary cutting elements 112.

In some embodiments, the secondary cutting elements 114 may be employed as depth of cut control (DOCC) features, as taught in, for example, U.S. patent application Ser. No. 09/383,228, titled "DRILL BITS WITH CONTROLLED CUTTER LOADING AND DEPTH OF CUT," filed Aug. 26, 1999, now U.S. Pat. No. 6,298,930, and as taught in U.S. patent application Ser. No. 12/766,988, titled "BEARING BLOCKS FOR DRILL BITS, DRILL BIT ASSEMBLIES INCLUDING BEARING BLOCKS AND RELATED METHODS," filed Apr. 26, 2010, the entire disclosure of each of which is incorporated by this reference herein. In some embodiments, at least one secondary cutting element 114 may be positioned to rotationally lead or precede at least one associated primary cutting element 112. The associated primary cutting elements 112 and secondary cutting elements 114 may be disposed on different blades, or they may be disposed on the same blade. The primary cutting elements 112 may be mounted to the blades 108 in each of the cone region, nose region, shoulder region, and gage region thereof. The secondary cutting elements 114 may be mounted in, for example, the cone region thereof. The secondary cutting element 114 may be recessed or underexposed relative to the associated primary cutting element 112 such that, upon initial cutting action of an earth-boring tool, the primary cutting elements 112 may engage and cut formation material while the secondary cutting elements 114 do not engage and cut formation material.

Alternatively or additionally, the secondary cutting elements 114 may engage the formation material concurrently with the primary cutting elements 112. As the secondary cutting elements 114 engage the formation material, the drill bit 304 may ride on the secondary cutting elements 114 while the primary cutting elements 112 engage with the formation material. The secondary cutting elements 114 may substantially limit the depth of cut of the primary cutting elements 112. The surface area 152 of the flat surface 138 of the secondary cutting element 114 may be sufficient to support and distribute the load attributable to the WOB. By providing the flat surface 138 on secondary cutting elements 114 as previously described, the WOB may be substantially increased over the WOB usable in drilling operations with conventional drill bits lacking DOCC features and over the WOB usable in drilling operations with dome-shaped DOCC features as described in the references incorporated herein.

Figure 10:
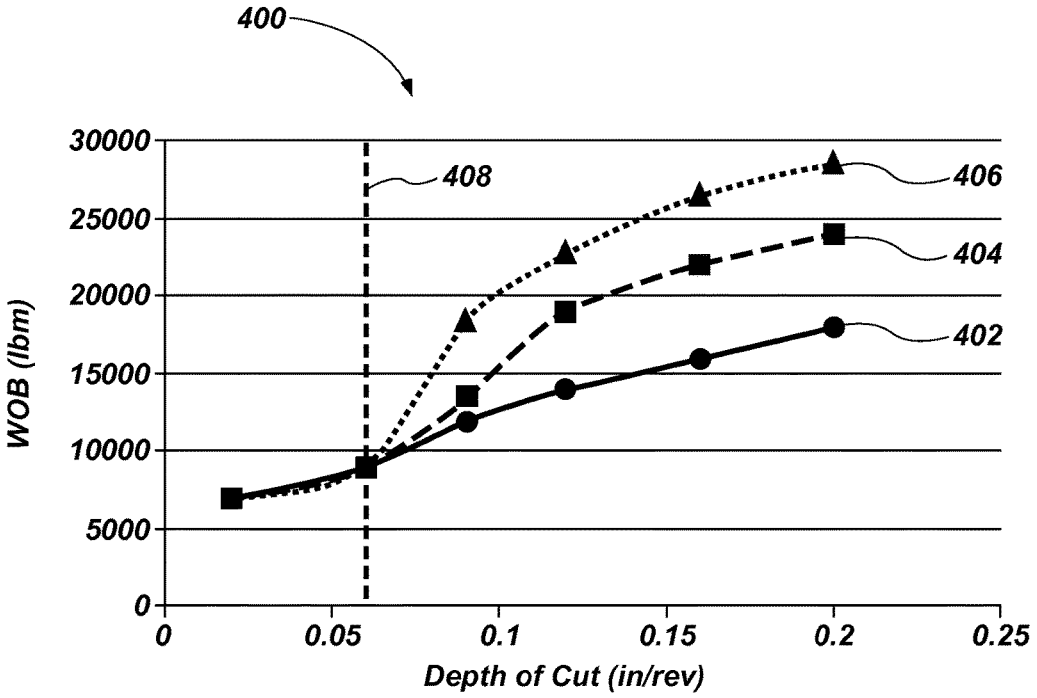
FIG. 10 is a graph illustrating the relationship between the weight-on-bit required to maintain a given depth of cut of conventional drill bits or a drill bit according to some embodiments without adversely affecting the drill bit during drilling operations.

FIG. 10 is a graph 400 of the relationship between the WOB required to maintain a given depth of cut of the drill bit without adversely affecting the drill bit or the primary cutting elements mounted thereto during drilling operations. Curve 402 illustrates the relationship for a drill bit lacking DOCC features, curve 404 illustrates the relationship for a drill bit comprising dome-shaped DOCC features as described in the references incorporated herein, and curve 406 illustrates the relationship for a drill bit 304 comprising cutting elements 112, 114 as described herein. A line 408 indicates a depth of cut at which the dome-shaped DOCC features or the secondary cutting elements 114 engage the formation material. As illustrated by FIG. 10, the drill bit 304 comprising cutting elements 112, 114 is mathematically predicted to be able to support a greater WOB at any given depth of cut compared to drill bits either lacking DOCC features or comprising dome-shaped DOCC features.

Figure 11:
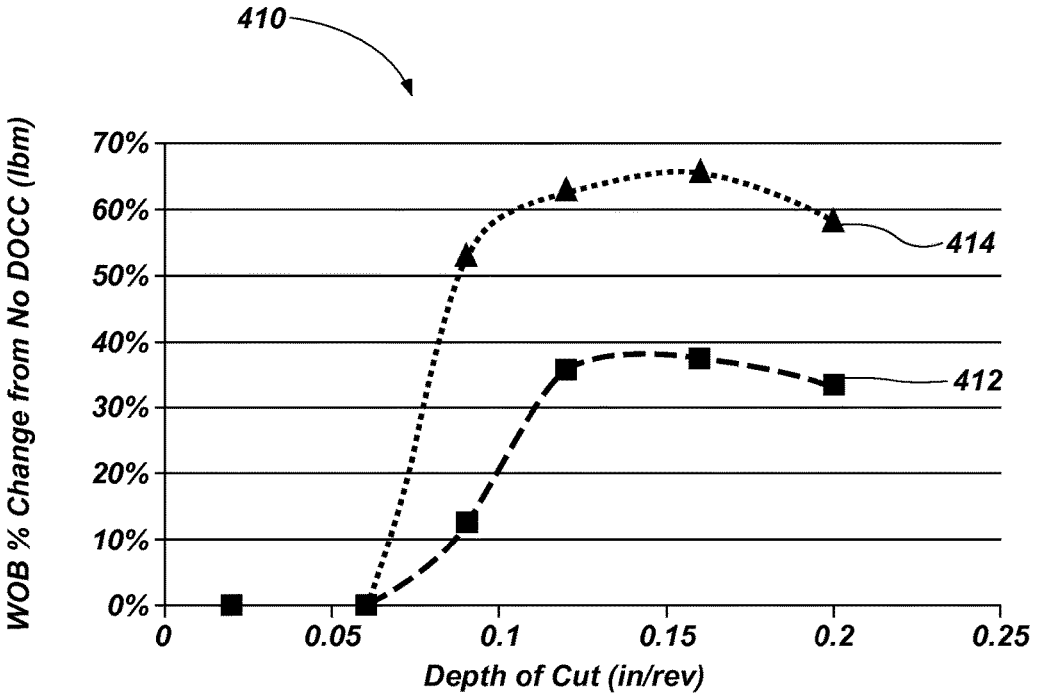
FIG. 11 is a graph illustrating the relationship between the increase in weight-on-bit measured as a percent change of weight-on-bit usable with drill bits comprising either dome-shaped depth of cut control features or secondary cutting elements according to some embodiments of the present disclosure as compared to the weight-on-bit usable in drilling operations with drill bits lacking depth of cut control features.

FIG. 11 is a graph 410 of the relationship between the increase in WOB measured as a percent change of WOB usable with drill bits comprising either dome-shaped DOCC features or secondary cutting elements 114 as compared to the WOB usable in drilling operations with drill bits lacking DOCC features. Curve 412 is the actual percent increase in WOB for drill bits comprising dome-shaped DOCC features compared to drill bits lacking DOCC features. Curve 414 is the mathematically predicted increase in WOB for drill bits comprising cutting elements 112, 114 as described herein compared to drill bits lacking DOCC features. The WOB for drill bits, such as drill bit 304 comprising cutting elements 112, 114 may be increased by up to approximately 68% compared to drill bits lacking DOCC features and by up to approximately 30% compared to drill bits comprising dome-shaped DOCC features.

While the present invention has been described herein with respect to certain illustrated embodiments, those of ordinary skill in the art will recognize and appreciate that it is not so limited. Rather, many additions, deletions, and modifications to the illustrated embodiments may be made without departing from the scope of the invention as hereinafter claimed, including legal equivalents thereof. In addition, features from one embodiment may be combined with features of another embodiment while still being encompassed within the scope of the invention as contemplated by the inventors.

What is claimed is:

1. An earth-boring tool for forming a wellbore in a subterranean formation, comprising:

a tool body; and cutting elements mounted on the tool body, the cutting elements comprising:

primary cutting elements defining a primary cutting profile of the earth-boring tool; and secondary cutting elements defining a secondary cutting profile recessed relative to the primary cutting profile such that, upon initial cutting action of the earth-boring tool in an unworn condition, the primary cutting elements will engage and cut a formation material while the secondary cutting elements do not engage and cut the formation material, and such that the secondary cutting elements will engage the formation material only after the primary cutting elements reach a worn condition, each secondary cutting element comprising a flat surface oriented at an angle relative to a longitudinal axis of the secondary cutting element and extending between a front cutting face and a peripheral side surface of the secondary cutting element, the secondary cutting element oriented for substantially simultaneous engagement of an entire surface area of the flat surface of the secondary cutting element with the formation material.

2. The earth-boring tool of claim 1, wherein each secondary cutting element is oriented at a back rake angle on the tool body.

3. The earth-boring tool of claim 2, wherein the angle at which the flat surface is oriented relative to the longitudinal axis of the secondary cutting element is at least substantially equal to the back rake angle of the secondary cutting element.

4. The earth-boring tool of claim 2, wherein the back rake angle is between about 15° and about 25°.

5. The earth-boring tool of claim 1, wherein at least one secondary cutting element is a backup cutting element.

6. The earth-boring tool of claim 1, wherein the flat surface of each secondary cutting element is oriented parallel to a plane tangent to an outer surface of the tool body at a location at which the respective secondary cutting element is mounted to the tool body.

7. The earth-boring tool of claim 1, wherein the secondary cutting profile is recessed relative to the primary cutting profile by an average distance of at least 1 mm.

8. The earth-boring tool of claim 7, wherein the secondary cutting profile is recessed relative to the primary cutting profile by an average distance of at least 2.54 mm.

9. The earth-boring tool of claim 8, wherein the secondary cutting profile is recessed relative to the primary cutting profile by an average distance of at least 4 mm.

10. The earth-boring tool of claim 1, wherein the worn condition of the primary cutting elements at which the secondary cutting elements will engage the formation material is an at least substantially dull condition of the primary cutting elements.

11. The earth-boring tool of claim 1, wherein the peripheral side surface of each secondary cutting element is cylindrical.

12. The earth-boring tool of claim 1, wherein the front cutting face of each secondary cutting element is planar.

13. The earth-boring tool of claim 1, further comprising additional secondary cutting elements that do not include flat surfaces oriented at an angle relative to longitudinal axes of the additional secondary cutting elements and extending between front cutting faces and peripheral side surfaces of the additional secondary cutting elements.

14. A method of forming an earth-boring tool for forming a wellbore in a subterranean formation, the method comprising:

mounting primary cutting elements on a tool body, the primary cutting elements located and oriented so as to define a primary cutting profile of the earth-boring tool; and mounting secondary cutting elements on the tool body, the secondary cutting elements located and oriented to define a secondary cutting profile recessed relative to the primary cutting profile such that, upon initial cutting action of the earth-boring tool in an unworn condition, the primary cutting elements will engage and cut a formation material while the secondary cutting elements do not engage and cut the formation material, and such that the secondary cutting elements will engage the formation material only after the primary cutting elements reach a worn condition, each secondary cutting element comprising a flat surface oriented at an angle relative to a longitudinal axis of the secondary cutting element and extending between a front cutting face and a peripheral side surface of the secondary cutting element, the secondary cutting element oriented for substantially simultaneous engagement of an entire surface area of the flat surface with the formation material.

15. The method of claim 14, further comprising selecting the angle at which the flat surface is oriented relative to the longitudinal axis of the secondary cutting element to be at least substantially equal to a back rake angle at which the secondary cutting element is respectively mounted to the tool body.

16. The method of claim 15, further comprising selecting the back rake angle to be between about 15° and about 25°.

17. The method of claim 14, further comprising recessing the secondary cutting profile relative to the primary cutting profile by an average distance of at least 1 mm.

18. The method of claim 14, further comprising recessing the secondary cutting profile relative to the primary cutting profile such that the worn condition of the primary cutting elements at which the secondary cutting elements will engage the formation material is an at least substantially dull condition of the primary cutting elements.

19. A method of using an earth-boring tool for forming a wellbore in a subterranean formation, the method comprising:

disposing an earth-boring tool for forming a wellbore in a subterranean formation;

engaging the subterranean formation with primary cutting elements on a tool body of the earth-boring tool and without engaging the subterranean formation with secondary cutting elements on the tool body, wherein the primary cutting elements are located and oriented so as to define a primary cutting profile of the earth-boring tool and the secondary cutting elements are located and oriented to define a secondary cutting profile recessed relative to the primary cutting profile, each of the secondary cutting elements comprising a flat surface oriented at an angle relative to a longitudinal axis of the secondary cutting element and extending between a front cutting face and a peripheral side surface of the secondary cutting element, each secondary cutting element oriented for substantially simultaneous engagement of an entire surface area of the flat surface with the formation material;

rotating the earth-boring tool within the wellbore and cutting a formation material with the primary cutting elements and wearing the primary cutting elements;

after wearing the primary cutting elements to a worn condition, engaging the subterranean formation with the secondary cutting elements; and detecting the engagement of the subterranean formation with the secondary cutting elements at a surface of the formation and removing the earth-boring tool from the wellbore before the earth-boring tool is damaged beyond repair.

20. The method of claim 19, wherein detecting the engagement of the subterranean formation with the secondary cutting elements at the surface of the formation comprises detecting at the surface an increase in a rate at which weight-on-bit (WOB) is increasingly applied to the earth-boring tool to maintain a given rate of penetration (ROP) of the earth-boring tool in the wellbore.

* * * * *